United States Patent [19]

Sellors

[11] 4,117,972

[45] Oct. 3, 1978

[54] MULTI-CELLED CARTON WITH SELF-LOCKING FEATURE

[75] Inventor: Thomas J. Sellors, Waukegan, Ill.

[73] Assignee: Potlatch Corporation, San Francisco, Calif.

[21] Appl. No.: 779,356

[22] Filed: Mar. 21, 1977

[51] Int. Cl.[2] ..... B65D 5/48

[52] U.S. Cl. ..... 229/28 R; 229/29 B

[58] Field of Search ..... 229/28 R, 29 B

[56] References Cited

U.S. PATENT DOCUMENTS

| | | | |
|---|---|---|---|
| 2,640,589 | 6/1953 | Foster et al. | 229/28 R |
| 2,759,652 | 8/1956 | Burgess | 229/28 R |
| 3,175,751 | 3/1965 | Burgess | 229/28 R |
| 3,514,031 | 5/1970 | Burgess | 229/28 R |
| 3,743,168 | 7/1973 | Forbes, Jr. | 229/28 R |

*Primary Examiner*—William Price
*Assistant Examiner*—Allan N. Shoap
*Attorney, Agent, or Firm*—Jack E. Dominik

[57] ABSTRACT

A multi-celled carton having automatically locking cells is disclosed comprising a gang lift member having a tree portion and at least one partitioned wall. The partitioned walls have a position co-planer with the front panel and a carton set up position being substantially perpendicular with the bottom panel. A locking means is also disclosed which is utilized for automatically locking the partitioned walls in their substantially perpendicular disposition relative to the bottom panel. The locking means comprises a side locking panel having a first and second discontinuous fold lines and a plurality of parallel cut lines which define a plurality of parallelogram-shaped panels.

7 Claims, 9 Drawing Figures

MULTI-CELLED CARTON WITH SELF-LOCKING FEATURE

FIELD OF THE INVENTION

The present invention relates to an automatic locking arrangement for the partition walls of a multi-celled carton, and more specifically to a multi-celled carton formed by a gang lift member.

DESCRIPTION OF THE PRIOR ART

Various multi partitioned or celled cartons having one or more gang lift features exist in the prior art as seen from U.S. Pat. Nos.: 3,743,168; 3,514,031; 3,175,751; 2,759,652; and RE. 23,597. Prior to Pat. No. 3,743,168, the partitions of the prior art cartons were maintained in their operative set-up positions by utilizing separate gluing steps, or separate stapling steps. These means for creating an erected multi cell carton required manual steps in setting the carton up. The state of the art was advanced by Pat. No. 3,743,168 in which the carton structure disclosed therein eliminated the need for manual steps in setting up a multiple cell carton by providing the user with a fully glued carton in collapsible condition that was capable of being set up with the gang lifts automatically locking into position. This automatic locking of U.S. Pat. No. 3,743,168 was accomplished by having the locking edges 31 of the gang lift element 18 becomming automatically engaged with the locking tabs 32 of the glue flap 15 which had previously been secured to the bottom panel 11. This locking or catch arrangement suffers from certain drawbacks which makes it an unreliable and difficult to maintain securement of the partitions. More specifically, the catch arrangement disclosed therein consist of an abutting relationship of the gang lift element and the locking tab, with such an arrangement being easily disengaged since there is no overlapping relationship. For instance, a slight bowing upward of the carton disengages most if not all of the catch arrangements for each partition, resulting in the collapse of the carton. Accordingly, it can readily be seen that there is a need in the industry for a reliable, locking structure for multiple cell cartons utilizing a hang lift feature which is difficult to disengage, simple, inexpensive to manufacture and maintain, and yet sufficiently strong to be durable under continued use, easy to erect into an upright position, and structurally efficient in forming a sturdy carton.

SUMMARY OF THE INVENTION

The present invention is directed toward a locking arrangement for a carton, such carton having at least one automatically locking partition wall for rotation between a substantially parallel planar relationship to the top and bottom panels to a substantially perpendicular planar relationship to the top and bottom panels. The locking arrangement automatically locks the partition walls in their substantially perpendicular disposition whereby a plurality of cells or compartments are thereby defined. The locking arrangement comprises a side locking panel having first and second discontinuous fold lines and a plurality of parallel cut lines disposed in transverse relationship to said discontinuous fold lines. The discontinuous fold lines define a plurality of parallelogram - shaped panels between adjacent cut lines. When a first attachment portion adjacent one of the discontinuous lines is extended outward in one direction in substantially perpendicular relationship to the parallelogram shaped panels and a second attachment portion adjacent the other discontinuous line is extended outward in the opposite direction in substantially perpendicular relationship to the parallelogram-shaped panels, a plurality of catches are thereby formed. The partition walls lockingly engage these catches when the partition walls are disposed in their substantially perpendicular disposition.

In view of the foregoing, an object of the present invention is to provide an arrangement having a plurality of catches formed from a single piece of paperboard capable of having a flat planar disposition when disposed in a knock-down disposition and forming a plurality of catches when in a set-up disposition.

Another object of the present invention is to provide a multi-celled carton having automatically locking partitions which are retained in substantially perpendicular relationship to the bottom of the carton by a plurality of catches formed in a side locking panel.

Another object of the present invention is to provide a multi-celled carton having a locking arrangement for automatic locking a gang lift member defining multiple cells.

Another object of the present invention is to provide a multiple cell carton formed from a single blank of paperboard.

DESCRIPTION OF THE DRAWINGS

Further objects and advantages of the present invention will become apparent as the following description proceeds, taken into conjunction with the accompanying drawings in which.

DETAILED DESCRIPTION OF THE PREFERRED EMBODIMENT

Figure 1:
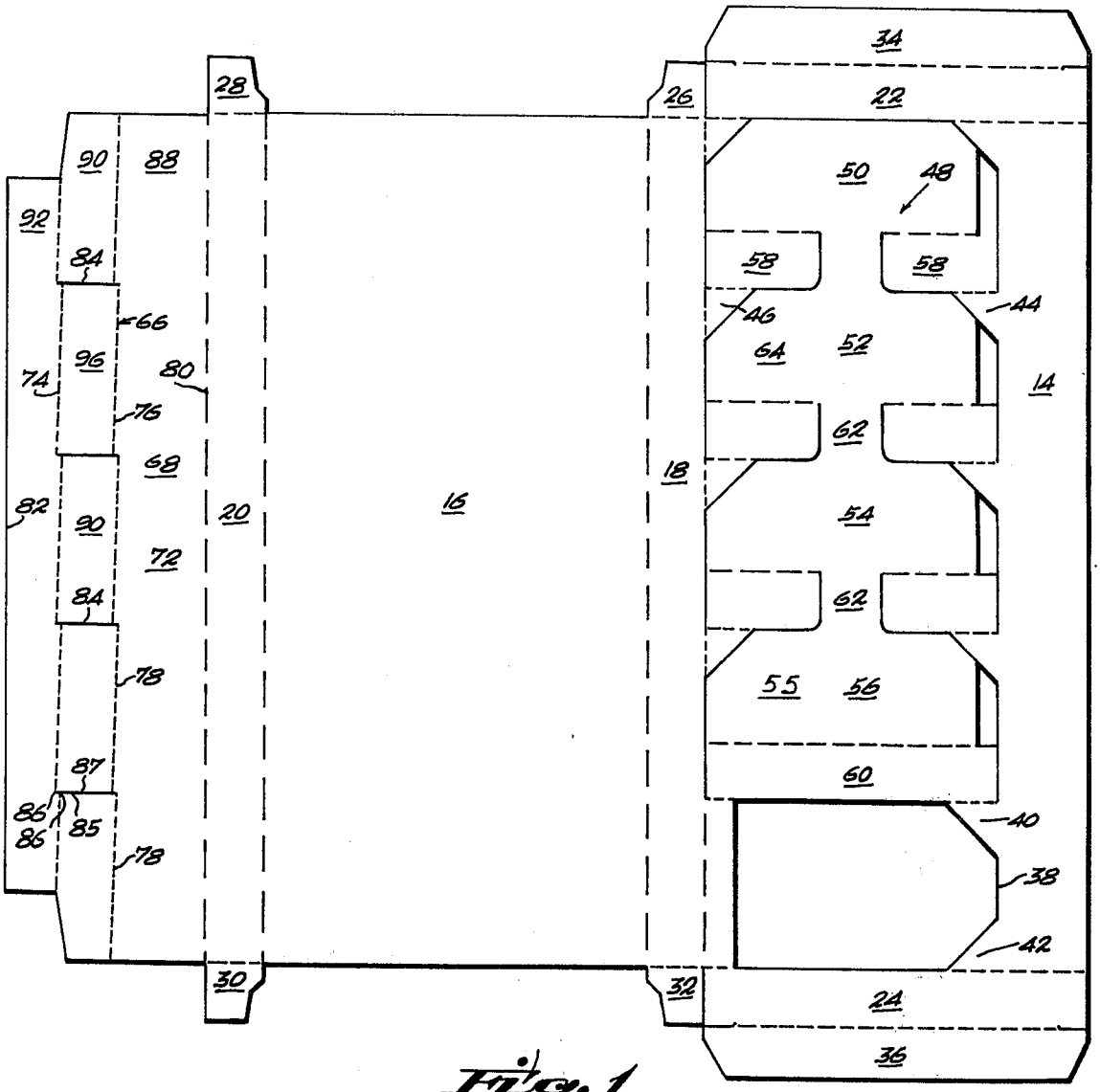
FIG. 1 is a plan view of the blank of the subject carton.
Figure 2:
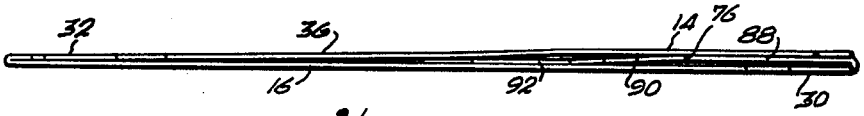
FIG. 2 is an enlarged end view of the subject carton in its collapsed, knock-down condition.
Figure 3:
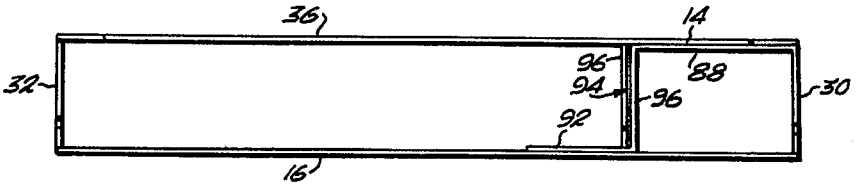
FIG. 3 is an enlarged end view of the subject carton in its erected, set-up condition.
Figure 9:
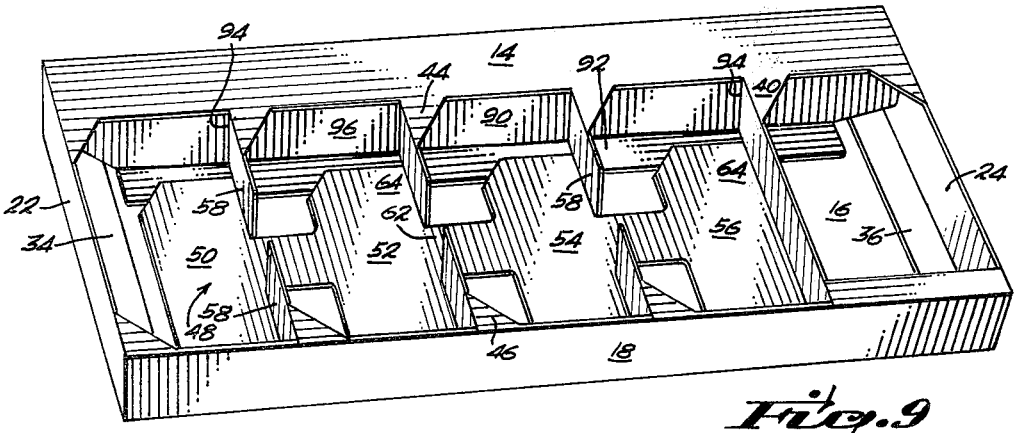
FIG. 9 is a perspective view of the subject carton in its erected, set-up condition with the gang lift member in its co-planar disposition.
Figure 6:
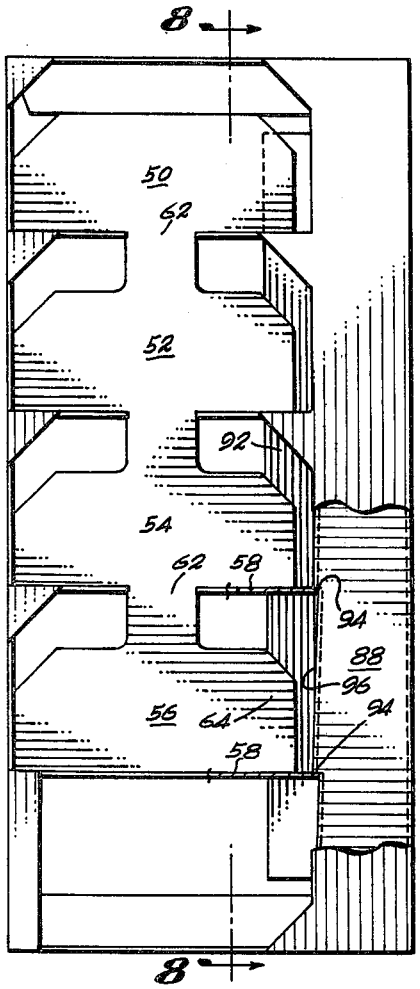
FIG. 6 is a partially broken top view of the subject carton in its erected, set-up condition with the gang lift member in its perpendicular disposition.
Figure 7:
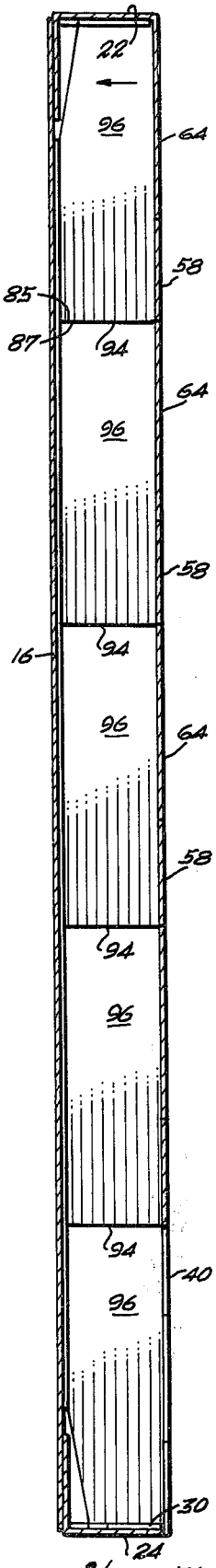
FIG. 7 is an enlarged cross-sectional view of the subject carton taken along section line 7—7 of FIG. 5.
Figure 8:
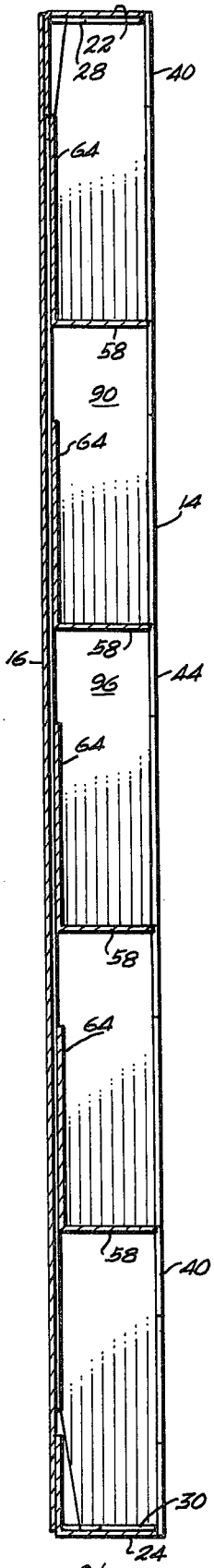
FIG. 8 is an enlarged cross-sectional view of the subject carton taken along section line 8—8 of FIG. 6.

Referring to FIG. 1, a single blank of paperboard 10 or other like sheet material, is shown with its plurality of cut and score lines so that when the blank is folded and glued together, a box 12, as shown in FIGS. 3, 6 and 9, is formed. The box 12 comprises top and bottom panels 14 and 16 respectively, and border walls 18, 20, 22 and 24. When the carton is erected, the border walls are substantially perpendicular to the top and bottom panels 14 and 16 and comprise a pair longer border walls which may be considered side border walls 18 and 20 and a pair of shorter border walls which may be considered end border walls 22 and 24. In the preferred embodiment, side border walls 20 and 18 are hingedly attached by fold lines to opposed longer edges of bottom panel 16 and end border walls 22 and 24 are hingedly attached by fold lines to the shorter opposed edges of top panel 14. However, other combinations of attachments of panels can lead to the formation of the desired box 12. Preferably, a plurality of tabs 26, 28, 30 and 32 may be hingedly attached by score lines to opposed shorter edges of each of the side border walls 20 and 18. On the edge oppositely disposed from the edge attached to the top panel 14, for both end border walls 22 and 24, there is hingedly attached by score lines end tuck flaps 34 and 36 respectively.

Top panel 14 has formed at one end thereof an opening 38 ideally being partially defined by opposed corner braces 40 and 42. In the preferred embodiment, the remaining portion of top panel 14 adjacent the opening 38 is cut and scored to define a single gang lift portion 48. Although only a single gang lift portion 48 is shown in the preferred embodiment, the locking arrangement in which the invention lies, to be described hereinafter, can be used with a box having any number of gang lift portions 48 and with different multiples of cells or compartments in each gang lift portion 48. As shown in FIG. 6, gang lift portion 48 of the preferred embodiment defines four cells or compartments 50, 52, 54, and 55 disposed in a series relationship along the longer dimensions of top panel 14. To create these cells, the top panel 14 is cut and scored to form the single gang lift portion 48 having a tree member 56 which extends throughout the length of the gang lift 48, a plurality of divided partition walls 58, each corresponding to one of the cell 50, 52, and 54 and divided by the tree member 56 and undivided partition wall 60 disposed to one end of the gang lift 48 but not divided by the tree member 56. More specifically, the tree member has a central continuous trunk portion 62 and oppositely disposed laterally protruding branch portions 64, with the trunk portion 62 dividing the partition walls 58. In cutting and scoring the gang lift member 48, a pair of corner braces 46 and 44 are formed for each of the cells. The specific structure of gang lift member 48, as described in this paragraph, is of a commonly known design and per se forms no part of the present invention.

The carton of this type is adapted to be squared, erected, filed and sealed on high speed machinery without attendant manual manipulation. In the erection of the carton the gang lift member 48 is moved downward with the tree portion engaging the bottom panel 16. An automatic locking arrangement 66 is provided and it is here where the novelty and invention lies.

Figure 4:
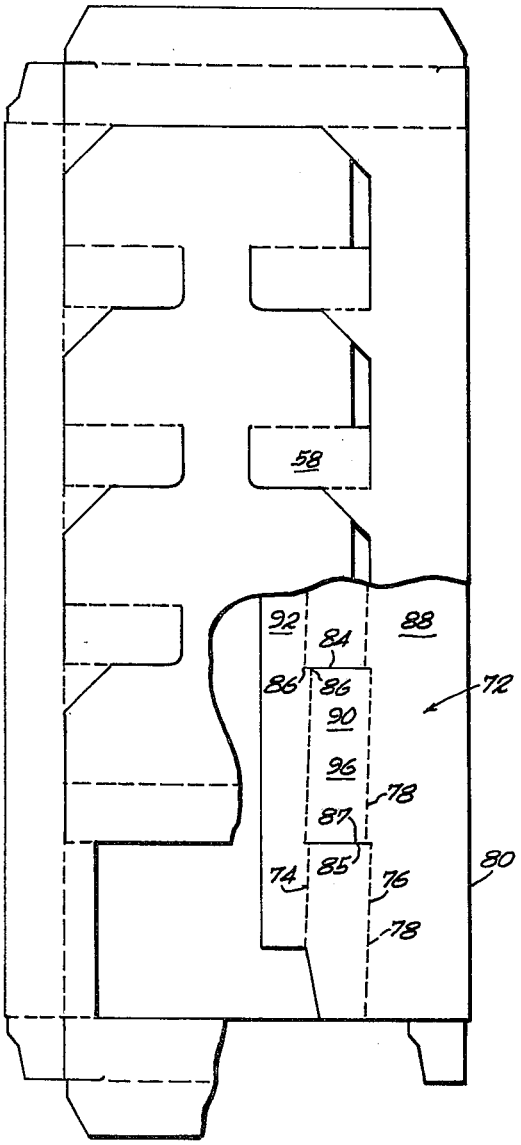
FIG. 4 is a partially broken top view of the subject carton in its collapsed, knock-down condition.
Figure 5:
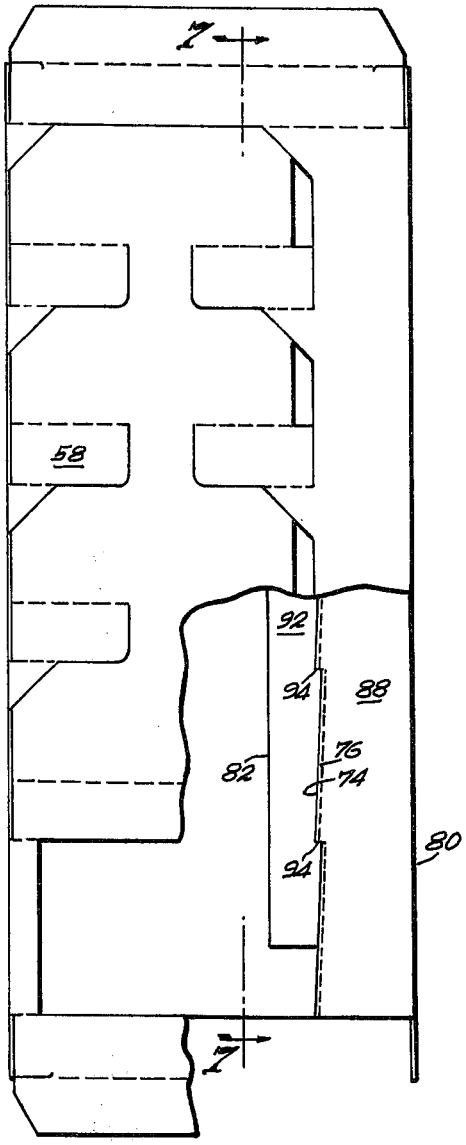
FIG. 5 is a partially broken top view of the subject carton in its erected, set-up condition with the gang lift member in its co-planar disposition.

As depicted in FIGS. 1 and 4, the locking arrangement 66 includes a locking panel side 72. Disposed along the longer dimensions of the locking panel 72 is a pair of parallel discontinuous fold lines 74 and 76. Each of these fold lines 74 and 76 are formed from a plurality of short fold lines 78 which are disposed in a line that is at an angle with the opposed longer edges of the locking panel 72. Each end of one short fold line 78 which is adjacent to the end of another short fold line 78 is offset relative thereto, but the center points of each short line 78, defining only one fold line 74 or 76, are aligned along a common axis, such axis being parallel to the longer edges 80 and 82 of the locking panel 72. Transverse cut lines 84 are disposed between the two discontinuous fold lines 74 and 76 and are substantially perpendicular to the longer edges 80 and 82. These cut lines 84, at both of their opposed ends, intersect the discontinuous fold lines 74 and 76 at points in which the same become discontinuous and more specifically, the adjacent ends 86 of both short fold lines adjacently disposed at such point of discontinuity terminate on the cooperatively positioned intersecting cut line 84.

Ideally the side locking panel 72 is hingedly attached along its longer edge 80 to side border panel 20. However, other edges of attachment for this locking panel are possible, such as the ends of top panel 14 which is oppositely disposed from the edge of top panel 14 connected to side border wall 18. The area between discontinuous fold line 76 and edge 80 defines a portion of the side locking panel 72 which is labeled the first attachment portion 88. The portion of the side locking panel 72 disposed between the discontinuous fold lines 74 and 76 is defined as catch-forming wall portion 90 and the portion between discontinuous fold line 74 and free edge 82 is defined as second attachment portion 92. Each area between the two discontinuous fold lines 74 and 76 and also between adjacent cut lines 84 is defined as a parallelogram-shaped panel 96. As can be seen from the cross sectional view of FIG. 3, the first attachment portion 88 extends the placement of the side locking wall 90 relative to side border wall 20 so as maintain a spaced apart relationship between the same. The first attachment portion 88 also serves the purpose of providing an area to which the top panel 14 can be adhesively adhered to. The second attachment portion 92 is orientated and adhesively attached to the bottom panel 16 so that the catch-forming wall portion 90 is substantially parallel to the side border walls 20 and 22. This preferable construction utilizing the first attachment 88 allows for the covering up of the unaesthetic appearance of the catch-forming wall portion 90.

When the carton is erected, the parallogram-shaped panel 96, due to the immediately adjacent edges 87 and 85 of consecutively disposed panels 96 being offset relative to each other, causes the adjacent edge 85 of one panel 96 to be extended outward relative to the adjacent edge 87 of the panel 96 aligned next to the prior mentioned one. This extention of one panel 96 relative to another defines a catch 94, with each catch 94 proceeding from one end of the side wall locking portion 90 to the other end, being similarily defined so that the catch 94 similarly engages each of the partition walls 58 and 60.

It is important to note that in order to properly form the catches 94, both the first attachment portion 88 and the second attachment portion 92 must be at substantially right angles to the side locking wall portion 90 and more importantly the first attachment portion 88 and second attachment portion 92 take right angles in opposite directions. If the same were to take right angles in the same direction, forming a U-shaped configuration, the adjacent edge 85 and 87 would cross each other toward their centers. Therefore, a portion of edge 87 would prevent the partition walls 58 and 60 from being rotated sufficiently to lockingly engage the edge 85. This does not make it practical for the catch-forming wall portion 90 to be hingedly attached on each side between the bottom and top panel, since a ledge would have to be formed on one to receive the outwardly extending second attachment portion 92. Additionally, visible catches 94 would make an unattractive appearance for the box. Therefore, this invention utilizes the first attachment portion 88 in combination with the exterior panels 14, 16 and 20 to create a chamber in which to catch-forming wall portion 90 can be disposed out of view.

The partition walls 58 and 60 as they are being rotated downward to erect the plurality of cells, will slip pass the edge 85 of one of the panels 96. The end portion 98 of the portion walls 58 and 60 are disposed in overlapping relationship with the edge 85 once the same has been rotated past he same. Therefore, each partition wall 58 and 60 will be disposed in locking overlapping relationship with the correspondingly positioned catch 94.

Although particular embodiments of the invention have been shown and described in full here, there is no intention to thereby limit the invention to the details of such embodiments. On the contrary, the intention is to cover all modifications, alternatives, embodiments, usages and equivalents of multicelled carton as fall within the spirit and scope of the invention, specification and the appended claims.

What is claimed is:

1. A catch-forming arrangement formed from a single piece of paperboard capable of forming at least one catch for retaining one edge of a panel of a carton, said single piece of paperboard having first and second discontinuous fold lines and a plurality of parallel cut lines disposed in transverse relationship to said discontinuous fold lines, said first and second discontinuous fold lines defining a parallelogram-shaped panel between said adjacent cut lines, said first discontinuous fold line and one edge of said single piece of paperboard defining therebetween a first attachment portion, said second discontinuous line and the other edge of said single piece of paperboard defining therebetween a second attachment portion, said first and second discontinuous fold lines defining therebetween a catch-forming wall portion, said first attachment portion extending outwardly in one direction is substantially perpendicular relationship to said catch-forming wall portion and said second attachment portion extending outwardly in the opposite direction in substantially perpendicular relationship to said catch-forming wall portion, said catch-forming wall portion having a flat planar disposition when disposed in a knock-down disposition and forming at least one said catch when in a set-up disposition, said catch cooperatively positioned in abutting relationship to said one edge of said panel to be retained when said catch-forming wall portion arrangement is in its set-up disposition.

2. A multi-celled carton including a top panel and a bottom panel disposed is substantially parallel spaced-apart relationship to each other, said carton further including at least one partition wall disposed between said top and bottom panels for rotation between a substantially parallel planar relationship to said top and bottom panels to a substantially perpendicular planar relationship to said top and bottom panels, the improvement comprising locking means for automatically locking said partition wall in its substantially perpendicular disposition relative to said bottom and top panels, said locking means comprising:

a side locking panel having first and second discontinuous fold lines and a plurality of parallel cut lines disposed in transverse relationship to said discontinuous fold lines, said discontinuous fold lines defining a parallelogram-shaped panel between adjacent cut lines, said first discontinuous fold line and one edge of said side locking panel defining therebetween a first attachment portion, said second discontinuous line and the other edge of said side locking panel defining therebetween a second attachment portion, said first and second discontinuous fold lines defining a catch-forming wall portion therebetween, said first attachment portion extending outwardly in one direction in substantially perpendicular relationship to said catch-forming wall portion and said second attachment portion extending outwardly in the opposite direction in substantially perpendicular relationship to said catch-forming wall portion, said side locking panel attached to each of said bottom and top panels by one of said attachment portions, said catch-forming wall portion disposed for locking engagement of said partition wall when said partition wall is in substantially perpendicular disposition relative to said top and bottom panels, whereby said side locking panel is aesthetically disposed within the interior of said carton and said locking means is formed from a single piece of paperboard.

3. A multi-celled carton as in claim 2, said cut lines disposed in substantially perpendicular relationship to said top and bottom panels and the axis of rotation of said partition wall when the carton is set up, said side locking panel being hingedly attached by a fold line to one of said top and bottom panels whereby said carton is formed from a single piece of paperboard.

4. A multi-celled carton having automatically locking cells comprising top and bottom panels, oppositely disposed end border panels each extending between said top and bottom panels, oppositely disposed side border walls each extending between said top and bottom panels and each disposed in substantially perpendicular relationship to said end border panels, said top panel cut and scored to define at least one gang lift member having a tree portion and at least one divided partition wall, said divided partition wall hingedly connected to said top panel by a pair of corner braces for rotation between a position coplanar with said front panel and a carton set up position of being substantially perpendicular with said bottom panel, said tree portion including a trunk portion disposed in dividing, transverse relationship to said divided partition wall, said tree portion further including a pair of branches laterally disposed along said trunk portion and hingedly attached to said divided partition wall, the improvement comprising locking means for automatically locking said partition wall in its substantially perpendicular disposition relative to said bottom panel, said locking means comprising:

a side locking panel having a catch-forming wall portion, said catch-forming wall portion being disposed in substantially perpendicular relationship between said top and bottom panels, at least one catch integrally formed on said catch-forming wall portion and disposed adjacent to one edge of said divided partition wall for abutting and retaining said divided partition wall edge in its perpendicular position when the carton is set up, said catch defined by said side locking panel having first and second discontinuous fold lines and a plurality of parallel cut lines disposed in transverse relationship to said discontinuous fold lines, said cut lines disposed in substantially perpendicular relationship to said top and bottom panels, said discontinuous fold lines defining a parallelogram shaped panel between adjacent cut lines, said first discontinuous fold line and the attached edge of said side locking panel defining therebetween a first attachment portion, said second discontinuous line and the free edge of said side locking panel defining a second attachment portion, said first and second discontinuous fold lines defining said catch-forming wall portion therebetween, said first attachment portion extending outwardly in one direction in substantially perpendicular relationship to said catch-forming wall portion and said second attachment portion extending outwardly in the opposite direction in substantially perpendicular relationship to said catch-forming wall portion, whereby said side locking panel is formed into at least one said catch to lockingly maintain said partition in substantially perpendicular disposition relative to said bottom panel.

5. A multi-celled carton as in claim 4, said first attachment portion hingedly attached by fold lines to one of said side border walls, whereby said locking panel can be made from the same single blank of paperboard or like sheet material from which the rest of the carton is made.

6. A multi-celled carton as in claim 5, said first attachment portion folded inwardly relative to said top and bottom panels, whereby catch-forming wall portion is ascethically disposed in a non-visable manner within the interior of said carton.

7. A multi-celled carton as in claim 6, said bottom panel hingedly attached by oppositely disposed fold lines to each of said side border walls, said top panel hingedly attached by fold lines to said other side border wall not having said side locking panel attached thereto, whereby said carton including said side locking panel is formed from a single blank of paperboard.

* * * * *